US005775849A

United States Patent [19]

Sorkin

[11] Patent Number: 5,775,849

[45] Date of Patent: Jul. 7, 1998

[54] COUPLER FOR DUCTS USED IN POST-TENSION ROCK ANCHORAGE SYSTEMS

[76] Inventor: Felix L. Sorkin, P.O. Box 1503, Stafford, Tex. 77477

[21] Appl. No.: 638,885

[22] Filed: Apr. 25, 1996

[51] Int. Cl.[6] ..... E21D 21/00

[52] U.S. Cl. ..... 405/259.1; 285/322

[58] Field of Search ..... 405/259.1; 285/322; 403/305, 306; 411/389, 178, 383

[56] References Cited

U.S. PATENT DOCUMENTS

| | | | |
|---|---|---|---|
| 3,304,829 | 2/1967 | Raynovich, Jr. | 405/259.1 X |
| 5,038,834 | 8/1991 | Siegfried | 138/173 |
| 5,320,391 | 6/1994 | Lüthi | 285/365 |
| 5,474,335 | 12/1995 | Sorkin | 285/322 |
| 5,524,940 | 6/1996 | Wartluft | 285/322 |

OTHER PUBLICATIONS

VSL Corporation, VSL Post-Tensioning Systems, Mar. 1994, pp. 28–30.

Dywidag Systems Incorporation, Dywidag Rock and Soil Anchors, 1994, pp. 1–16.

*Primary Examiner*—Tamara L. Graysay
*Assistant Examiner*—Tara L. Mayo

[57] ABSTRACT

A duct system for a post-tension rock anchorage system including a first duct having a plurality of corrugations extending radially outwardly therefrom, a second duct having a plurality of corrugations extending radially outwardly therefrom, and a tubular body threadedly receiving the first duct at one end and threadedly receiving the second duct at an opposite end. The tubular body has a first threaded section formed on an inner wall of the tubular body adjacent one end of the tubular body and a second threaded section formed on the inner wall of the tubular body adjacent an opposite end of the tubular body. The threaded sections are formed of a harder polymeric material than the polymeric material of the first and second ducts. The tubular body has an outer diameter which is less than the diameter of the ducts at the corrugations. The first and second threaded sections have a maximum inner diameter which is less than the outer diameter of the ducts at the end of the ducts. First and second elastomeric seals are affixed to opposite end of the tubular body and juxtaposed against a surface of a corrugation of the first and second ducts.

20 Claims, 2 Drawing Sheets

10
12
14
16
18
20
22
24
26
30
32
34
36
38
40
42
44

COUPLER FOR DUCTS USED IN POST-TENSION ROCK ANCHORAGE SYSTEMS

TECHNICAL FIELD

The present invention relates to couplers for ducts used in post-tension systems. More particularly, the present invention relates to couplers for which are ducts used in post-tension rock anchorage systems.

BACKGROUND ART

Rock and soil anchors have opened a variety of new possibilities in the design for rock and underground work. Rock anchors are post-tensioned tendons installed in holes drilled into the ground, for which at least the entire bond length is located in rock. There the anchor force can be transmitted to the rock by either cement grout or resin. Freely movable anchors allow an uninhibited elongation of the tendons between stressing end and bond length. This way the anchor can be checked and retensioned at any time. Fully grouted anchors, on the contrary, are bonded to the rock and also in the free stressing length. Rock anchors can be installed in drill holes with any inclination. Rock anchors are usually applied for: (1) the anchorage of external tensile forces and uplift forces; (2) anchorage for retaining walls; (3) stabilization of very eccentrically loaded foundations; (4) stabilization of slopes, rock walls and cuts; and (5) systematic rock stabilization and coal supports for underground excavations and mines.

The rock anchorage systems include steel bars with rolled on continuous thread deformations or bundled strands for larger loads. These tendons are installed into drill holes which, in the case of rock, are made mostly by rotary percussion drilling. In loose soil, they are made either by rotary drilling, rotary percussion drilling or with a down-the-hole hammer, but always with a casing to prevent collapse. For firm soils, uncased holes can be drilled using augers. After installation of the anchors, a certain section of the tendon (otherwise known as the "bond length") is cement grouted for bonding with the soil or rock. For cased holes, the cement grout is injected under pressure through the casing, while retracting the casing at the same time. Downward sloped holes can be filled partially with grout, and then the anchor tendon is inserted, while, for upward sloped holes, the drill hole must be closed at the stressing end that is grouted through grout tubes. In this case, also a vent tube is required. After hardening of the grout in installation of the stressing end, the anchor can be stressed using hydraulic jacks. The tendon will be elongated in the free stressing length between bond length and the stressing end.

Since the anchorage systems are a permanent component of the structure and serve to guarantee its overall safety, protection of corrosion is of utmost importance. In the past, for single and bundled threadbar anchors, a double corrosion protection system was developed. The unbroken protection against corrosion over the full length of the bar is guaranteed by a grouted corrugated plastic sheathing. The chemically active corrosion protection by the cement grout passivates the steel surface. Furthermore, the stretchable corrugated plastic sheathing prevents the access of any aggressive media.

Unfortunately, in the past, the use of such corrugated plastic sheathing (otherwise known as the "duct system") requires the use of coiled ducts. The coiled ducts are long continuous lengths of ducts which can extend for great lengths. However, coiled ducts can only be formed of ducts having a relatively small diameter. Manufacturing processes limit the ability to form long continuous lengths of ducts having a large diameter. Large diameter duct systems tend to crack, deform, or collapse, if they are forced into a coiled form. Additionally, and furthermore, coiled ducts are relatively expensive due to the complicated manufacturing processes.

As can be seen, a problem exists whenever it is necessary to encapsulate a large number of tendons having a greater diameter than can be accommodated by conventional coiled duct systems. Under these circumstances, either the ducts are not used (which increases corrosion potential) or other, more complicated and cumbersome methods are employed for the protection of the tendon against corrosion. It has not been possible to use conventional straight sections of ducts since the presently available couplers would have a diameter greater than the diameter of the ducts. If such couplers were used with straight sections of ducts, then the couplers can be damaged or loosened when the sections of ducts are inserted into the drill hole. As such, a need has developed for the ability to use straight sections of larger diameter ducts in rock anchorage systems.

It is an object of the present invention to provide a duct system in which non-coiled ducts can be used in post-tension rock anchorages.

It is another object of the present invention to provide a duct system which allows for large diameter ducts to be used in post-tension rock anchorages.

It is a further object of the present invention to provide a duct system which encapsulates the tendons and prevents corrosion.

It is a further object of the present invention to provide a duct system which resists damage and destruction of the couplers during the installation of the ducts into the drill hole.

It is still a further object of the present invention to provide a duct system that facilitates the installation of the ducts into the drill hole.

It is still another object of the present invention to provide a duct system for post-tension rock anchorages which is easy to manufacture, and easy to use and relatively inexpensive.

These and other objects and advantages of the present invention will become apparent from a reading of the attached specification and appended claims.

SUMMARY OF THE INVENTION

The present invention is duct system for a post-tension rock anchorage system that comprises a first duct having a plurality of corrugations extending radially outwardly therefrom, a second duct having a plurality of corrugations extending radially outwardly therefrom, and a tubular body having a first threaded section for receiving one end of the first duct and a second threaded section for receiving one end of the second duct. The first and second threaded sections of the tubular body are formed of a harder polymeric material than the polymeric material used for the first and second ducts. The first and second threaded sections have a maximum inner diameter which is less than the outer diameter of the first and second ducts at the end of the duct. The tubular body has an outer diameter which is less than the diameter of the ducts at the corrugations. The threads of the first threaded section extend in an opposite direction than the threads of the second threaded section. Each of the first and second ducts and the tubular body have an annular cross-sectional area.

A first elastomeric seal is juxtaposed between one end of the tubular body and a corrugation of the first duct. A second elastomeric seal is juxtaposed between an opposite end of the tubular body and a corrugation of the second duct. These elastomeric seals are annular seals extending around the ends of the tubular body. The elastomeric seals have a configuration which matches the angular inclination of the corrugation of the first and second ducts.

DETAILED DESCRIPTION OF THE INVENTION

Figures 1, 2, 3:
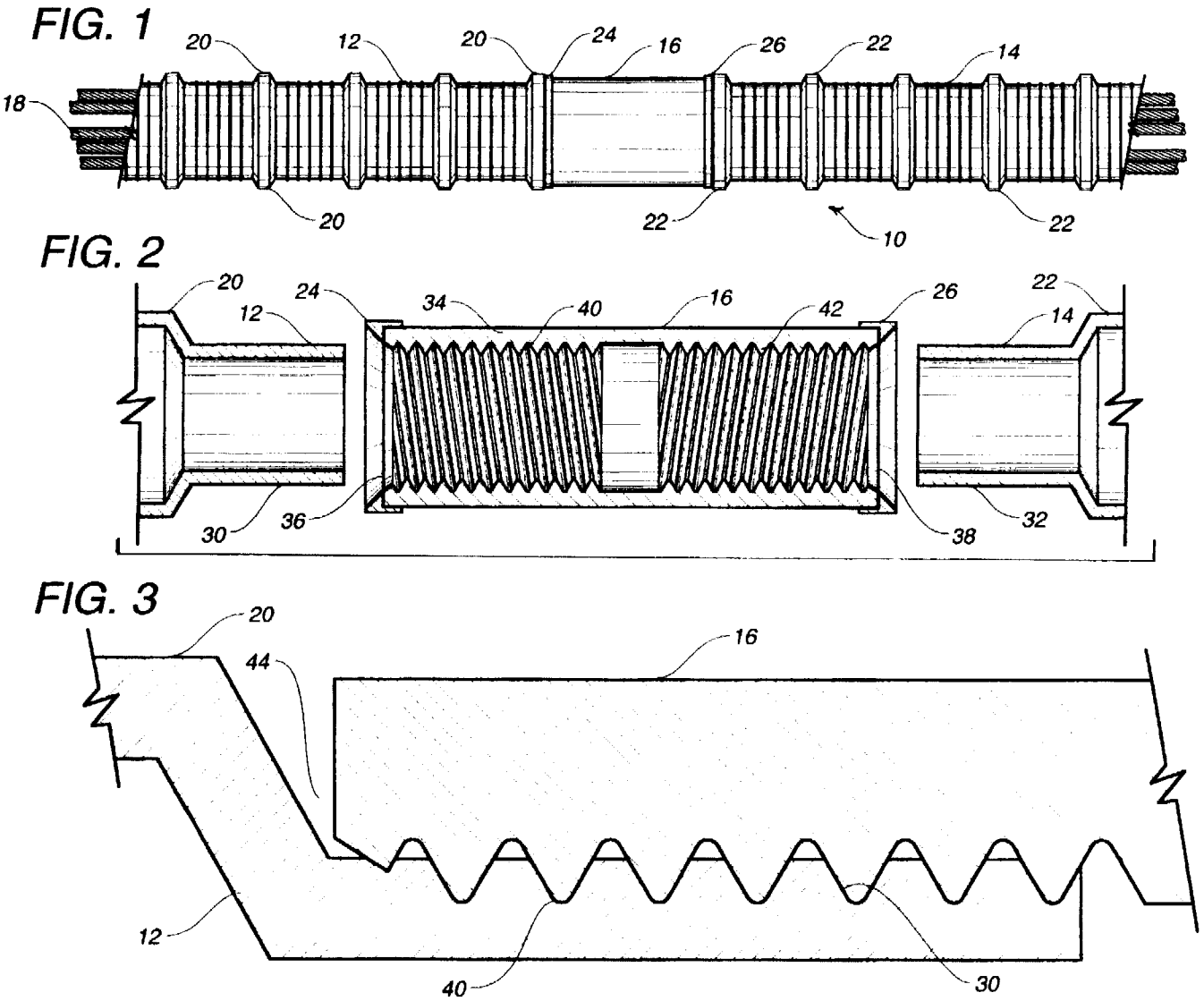
FIG. 1 is a side elevational view of the duct system in accordance with the present invention.
FIG. 2 is a cross-sectional view of the duct system of the present invention in its unassembled configuration.
FIG. 3 is a detailed cross-sectional view of the threading used on the duct system of the present invention.

FIG. 1 shows the duct system 10 of the present invention. The duct system 10 includes a first duct 12, second duct 14, and a coupler 16. The coupler 16 threadedly receives the ends of the first duct 12 and the second duct 14. A plurality of tendons 18 extend through the ducts 12 and 14 and the coupler 16.

As can be seen in FIG. 1, the first duct 12 has a generally round configuration. A plurality of corrugations 20 are formed on the first duct 12 and extend radially outwardly therefrom. Similarly, a plurality of corrugations 22 are formed on the second duct 14. These corrugations 22 extend radially outwardly of the second duct 14.

As will be described hereinafter, the coupler 16 is a tubular body which serves to join the ends of the first duct 12 and the second duct 14. A first elastomeric seal 24 is positioned on one end of the coupler 16 so as to be in juxtaposition with a corrugation 20 of the first duct 12. A second elastomeric seal 26 is positioned on the opposite end of the coupler 16 so as to be in juxtaposition with a corrugation 22 of the second duct 14. The elastomeric seals 24 and 26 serve to prevent water intrusion from entering the interior of the ducts 12 and 14 and the coupler 16. Also, as can be seen in FIG. 1, the outer diameter of the coupler 16 is slightly less than the outer diameter of the corrugations 20 and 22 on the ducts 12 and 14. As such, the coupler 16 will not become damaged during installation. The ducts 12 and 14 are generally rigid tubular ducts having a length of up to twenty feet. The use of the coupler 16 allows these rigid sections of ducts to be joined in end-to-end relationship for a great distance. As such, the use of the coupler 16 allows large diameter ducts (three inches or more) to be used in post-tension rock anchorage systems. The present invention also eliminates the need for coiled tubing.

FIG. 2 shows a cross-sectional view of the coupler 16 as used to join the ends 30 and 32 of ducts 12 and 14, respectively. As can be seen, the coupler 16 includes a tubular body 34 having an opening 36 at one end and an opening 38 at an opposite end. A first threaded section 40 is formed on an inner wall of the tubular body 34 adjacent end 36. A second threaded section 42 is formed on an inner wall of the tubular body 34 adjacent the opposite end 38 of the tubular body 34. These threaded sections 40 and 42 serve to threadedly receive the ends 30 and 32 of the ducts 12 and 14, respectively.

Importantly, as can be seen in FIG. 2, the ends 30 and 32 of the ducts 12 and 14, respectively, do not have matching threads formed thereon. As a result, it is necessary to form the threaded sections 40 and 42 of a harder material than the material used for the ducts 12 and 14. In conventional practice, the coupler 16 can be formed of a harder polymeric material than the polymeric material which is used for the ducts 12 and 14. By manufacturing the threaded sections 40 and 42 of a harder material, the threads of threaded sections 40 and 42 will engage the ends 30 and 32 of the ducts 12 and 14, respectively, so as to allow the ends to be self-threading into the coupler 16. By simply inserting the end 30 into the opening 36, the duct 12 can be rotated (or the coupler 16 rotated) so as to draw the end section 30 into the interior of the coupler 16. Similarly, the duct 14 can be rotated (or the coupler 16 rotated) so as to cause the end 32 of the duct 14 to be drawn into the interior of the coupler 16. Rotation of the duct continues until the coupler 16 comes into abutment with corrugation 20 of duct 12 and with corrugation 22 of duct 14. The elastomeric seals 24 and 26 will compress upon contact with the corrugations 20 and 22, respectively.

In FIG. 2, the first threaded section 40 will have threads that extend in a different direction than the threads of the second threaded section 42. As such, a single rotation of the coupler 16 will serve to draw both of the ducts 12 and 14 inwardly. As a result, assembly can be completed in a quick and easy manner.

So as to assure that the coupler 16 is not damaged during installation of the system 10 into a drill hole, the coupler 16 should have an outer diameter which is less than the outer diameter of the ducts 12 and 14 at the corrugations 20 and 22. The opening 36 should have a diameter which is greater than the diameter of the duct 12 at opening 30 so as to allow the end 30 of the first duct 12 to enter the opening 36. The first threaded section 40 will have a maximum inner diameter which is less than the outer diameter of the duct 12 at the end 30. As such, it can be assured that the threads 40 will sufficiently engage the duct 12 so as to form a tight fit. A similar arrangement applies to the configuration of the second threaded section 42 with respect to the end 32 of the second duct 14.

FIG. 3 shows a detailed view of the installation of the duct 12 into the coupler 16. As can be seen, the threads of the threaded section 40 will deform the surface of the end 30 so as to form mating threads. This is accomplished because the material of the threaded section 40 is harder than the material of the duct 12. The rotation of the threaded section 40 of the coupler 16 assures a tight fit between the threads of the threaded section 40 and the surface 30 of the ducts 12. Although it is unlikely that water penetration will occur between the area of engagement between the coupler 16 and the duct 12, an annular seal can be applied in area 44 so as to further assure that water penetration will not occur. It can also be seen that the coupler 16 extends upwardly for a distance less then the height of the corrugation 20. As a result, during installation, the coupler 16 will not become dislodged or damaged when it enters the drill hole.

Figure 4:
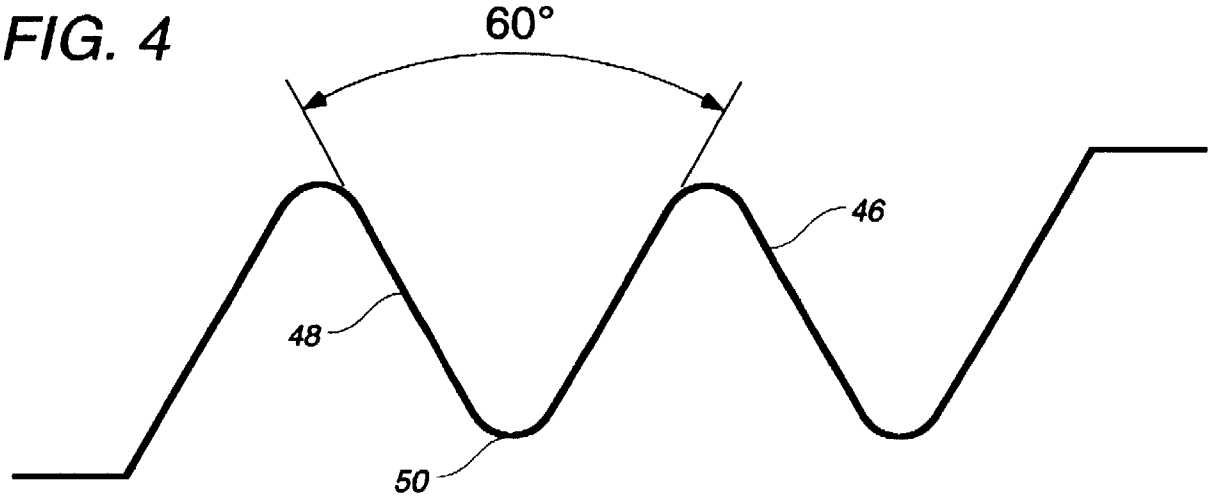
FIG. 4 is a detailed view of individual threads of the duct system of the present invention.

FIG. 4 shows a detailed view of an individual thread 46 with a coupler 16 and its engagement with a surface 48 of the duct 12. The thread 46 will have a profile of approximately sixty degrees. The smooth curved tip 50 of the thread 46 avoids any cutting into or tearing of the surface of the duct 48. The size and pitch of the individual threads will depend on the relative sizes of the ducts and couplers which are used.

Figure 5:
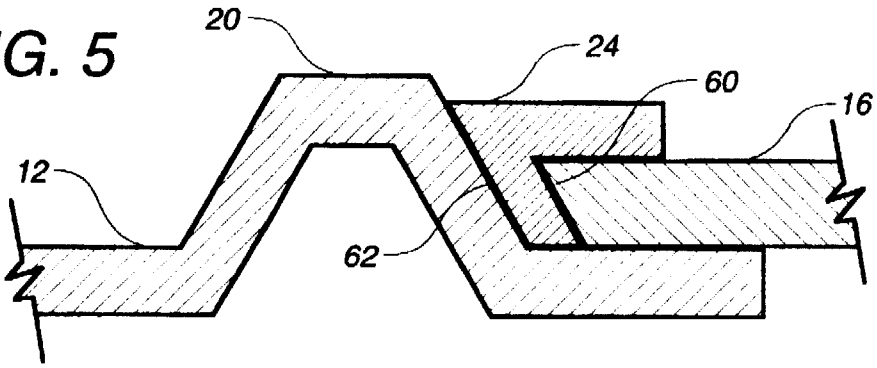
FIG. 5 is a detailed view of the configuration of the seal used in the duct system of the present invention.

FIG. 5 shows the engagement of the elastomeric seal 24 with a corrugation 20 of the first duct 12. After complete rotation of the coupler 16, the end 60 of the coupler 16 will reside in close proximity to a surface 62 of the corrugation 20. The corrugation 20 has a somewhat trapezoidal configuration with the surface 62 having an annular inclination. The surface 60 of the coupler 16 can have a complementary inclination so as to establish full surface-to-surface contact between the surfaces 60 and 62. Alternatively, the elastomeric seal 24 can have such a configuration so that the seal 24 tapers downwardly toward the opening of the coupler 16. As the coupler 16 is rotated relative to the duct 12, a tight compressive fit is established between the elastomeric seal 24 and the inclined surface 62 of the corrugation 20. The elastomeric seal 24 is an annular seal which extends around the opening 36 of the coupler 16. This arrangement should prevent water intrusion from entering the interior of the coupler 16 and the duct system 10.

The present invention facilitates the ability to use straight rigid sections of ducts in a post-tension rock (or soil) anchorage system. The configuration of the present invention allows large diameters of tendons to be employed in such rock anchorage systems. The configuration of the coupler assures easy installation of the ducts in end-to-end relationship. Also, the configuration of the coupler of the present invention serves to prevent intrusion of water, and other unwanted elements, into the interior of the ducts. A great deal of savings results from the ability to use conventional straight sections of ducts, rather than the expensive coiled ducts. The configuration of the coupler of the present invention is designed so that it does not extend outwardly beyond the diameter of the corrugations of the ducts. As such, it can be easily installed into the drill hole without becoming damaged or dislodged.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A coupler apparatus for use in post-tension rock anchorage systems comprising:

a first duct;

a second duct;

a tubular body having a maximum outer diameter not greater than a maximum outer diameter of said first and second ducts;

a first threaded section formed on an inner wall of said tubular body adjacent one end of said tubular body; and a second threaded section formed on said inner wall of said tubular body adjacent an opposite end of said tubular body, said first and second threaded sections formed of a harder material than a material of said first and second ducts, said first threaded section receiving an end of said first duct therein, said second threaded section receiving an end of said second duct therein.

2. The coupler of claim 1, said first threaded section of said tubular body having a maximum inner diameter less than an outer diameter of said end of said first duct.

3. The coupler of claim 1, said tubular body having an opening at one end having an inner diameter greater than an outer diameter of an end of one of said ducts.

4. The coupler of claim 1, said tubular body and said first and second threaded sections being integrally formed of a polymeric material.

5. The coupler of claim 1, said first threaded section having threads extending in an opposite direction than threads of said second threaded section.

6. The coupler of claim 5, each of said threads of said first and second threaded sections having an approximately 60° profile.

7. The coupler of claim 1, further comprising:

a first elastomeric seal affixed to one end of said tubular body; and a second elastomeric seal affixed to said opposite end of said tubular body.

8. The coupler of claim 7, said first elastomeric seal having an annular configuration extending around an opening at said one end, said second elastomeric seal having an annular configuration extending around an opening at said opposite end.

9. The coupler of claim 8, said first elastomeric seal extending outwardly from said one end of said tubular body, said first elastomeric seal tapering inwardly toward said opening at said one end.

10. A duct system for a post-tension rock anchorage system comprising:

a first duct having a plurality of corrugations extending radially outwardly therefrom, said first duct having a first outer diameter at one end and a second outer diameter at said corrugations, said second outer diameter being greater than said first outer diameter;

a second duct having a plurality of corrugations extending radially outwardly therefrom, said second duct having a first outer diameter at one end and a second outer diameter at said corrugations, said second outer diameter being greater than said first outer diameter; and a tubular body having a first threaded section formed on an inner wall of said tubular body adjacent one end of said tubular body, said first threaded section threadedly receiving said one end of said first duct, said tubular body having a second threaded section formed on the inner wall of said tubular body adjacent an opposite end of said tubular body, said second threaded section threadedly receiving said one end of said second duct.

11. The duct system of claim 10, said first and second ducts being formed of a polymeric material, said first and second threaded sections being formed of a harder polymeric material than said polymeric material of said first and second ducts.

12. The duct system of claim 10, said first threaded section having a maximum inner diameter less than said first outer diameter of said first duct, said second threaded section having a maximum inner diameter less than said first outer diameter of said second duct.

13. The duct system of claim 10, said tubular body having an outer diameter less than said second outer diameter of said first and second ducts.

14. The duct system of claim 10, said first threaded section having threads extending in an opposite direction than threads of said second threaded section.

15. The duct system of claim 10, said first duct having an end section having a length dimension extending to an edge of a first corrugation from said one end, said second duct having an end section having a length dimension extending to an edge of a first corrugation from said one end of said second duct, said tubular body having a length not less than a sum of said length dimensions of said first and second ducts.

16. The duct system of claim 10, each of said first and second ducts and said tubular body having an annular cross-sectional area.

17. The duct system of claim 10, further comprising:

a first elastomeric seal juxtaposed between said one end of said tubular body and a corrugation of said first duct; and a second elastomeric seal juxtaposed between said opposite end of said tubular body and a corrugation of said second duct.

18. The duct system of claim 17, said first and second elastomeric seals being annular seals extending around the ends of said tubular body.

19. The duct system of claim 18, said corrugation of said first duct extending outwardly of said first duct at an angular inclination, said first elastomeric seal having a configuration matching said angular inclination of said corrugation.

20. The duct system of claim 10, further comprising:

a plurality of tendons extending through an interior of said first duct, said second duct and said tubular body.

* * * * *